US008597865B2

(12) United States Patent
Ishizuka et al.

(10) Patent No.: US 8,597,865 B2
(45) Date of Patent: Dec. 3, 2013

(54) ELECTROSTATIC-IMAGE-DEVELOPING TONER, ELECTROSTATIC IMAGE DEVELOPER, IMAGE FORMING APPARATUS, AND IMAGE FORMING METHOD

(75) Inventors: Daisuke Ishizuka, Kanagawa (JP); Shinichi Yaoi, Kanagawa (JP); Yasushige Nakamura, Kanagawa (JP)

(73) Assignee: Fuji Xerox Co., Ltd., Toyko (JP)

( * ) Notice: Subject to any disclaimer, the term of this patent is extended or adjusted under 35 U.S.C. 154(b) by 766 days.

(21) Appl. No.: 12/699,385

(22) Filed: Feb. 3, 2010

(65) Prior Publication Data

US 2011/0070539 A1 Mar. 24, 2011

(30) Foreign Application Priority Data

Sep. 18, 2009 (JP) ..... 2009-217521

(51) Int. Cl.
*G03G 9/00* (2006.01)

(52) U.S. Cl.
USPC ..... 430/108.23; 430/108.4; 430/108.8; 430/119.2

(58) Field of Classification Search
USPC ..... 430/108.23, 108.4, 108.8, 119.2; 399/252, 264
See application file for complete search history.

(56) References Cited

U.S. PATENT DOCUMENTS

| | | | | |
|---|---|---|---|---|
| 4,910,560 | A | 3/1990 | Kanada | |
| 6,492,083 | B1 | 12/2002 | Livengood et al. | |
| 2004/0131962 | A1 * | 7/2004 | Nakamura et al. | 430/108.21 |
| 2004/0209178 | A1 * | 10/2004 | Itakura et al. | 430/45 |
| 2005/0221214 | A1 * | 10/2005 | Nagahama et al. | 430/108.1 |
| 2006/0210903 | A1 * | 9/2006 | Ohki et al. | 430/109.4 |
| 2009/0233211 | A1 * | 9/2009 | Takahashi et al. | 430/109.4 |

FOREIGN PATENT DOCUMENTS

| | | |
|---|---|---|
| JP | A-63-216087 | 9/1988 |
| JP | A-4-39671 | 2/1992 |
| JP | 2000-305319 | * 11/2000 |
| JP | A-2002-156795 | 5/2002 |
| JP | A-2003-156882 | 5/2003 |
| JP | A-2004-333629 | 11/2004 |
| JP | A-2005-17838 | 1/2005 |
| JP | A-2005-31163 | 2/2005 |
| JP | A-2007-41331 | 2/2007 |
| JP | A-2007-248746 | 9/2007 |

OTHER PUBLICATIONS

Office Action for corresponding Australian Patent Application No. 2010200498, dated Mar. 21, 2011.

* cited by examiner

*Primary Examiner* — Thorl Chea
(74) *Attorney, Agent, or Firm* — Oliff & Berridge, PLC

(57) ABSTRACT

An electrostatic-image-developing toner includes a polyester resin; two or more pigments; a polyethylene wax; and a polyolefin-polyvinyl-based graft copolymer, and satisfies the relationship represented by the following equation (1):

$$0.2 \leq wd/wp \leq 5.0 \quad (1)$$

wherein wp represents a total content (wt. %) of the pigments, and wd represents a content (wt. %) of the polyolefin-polyvinyl-based graft copolymer.

16 Claims, 1 Drawing Sheet

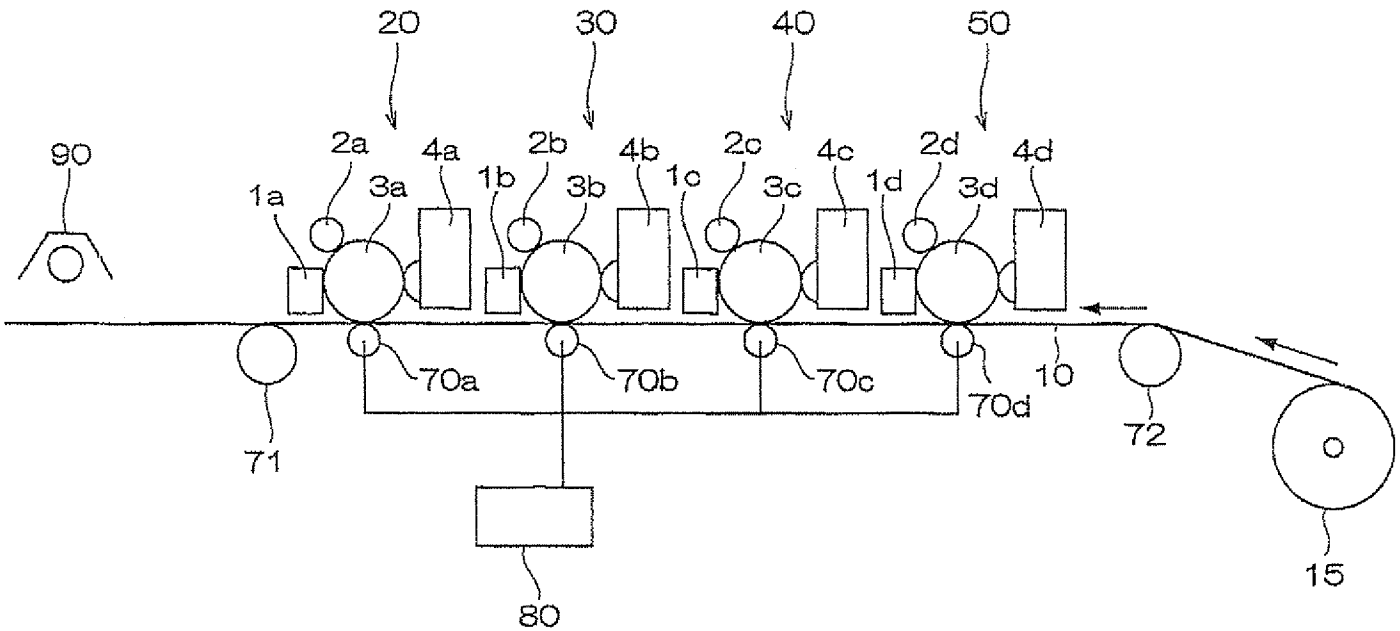
15
72
1b
70d
50
4d
3d
2d
1d
70c
40
4c
3c
2c
1c
70b
30
4b
3b
2b
1b
80
70a
20
4a
3a
2a
1a
71
90

ELECTROSTATIC-IMAGE-DEVELOPING TONER, ELECTROSTATIC IMAGE DEVELOPER, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2009-217521 filed on Sep. 18, 2009.

BACKGROUND

1. Technical Field

The present invention relates to an electrostatic-image-developing toner, an electrostatic image developer, an image forming apparatus, and an image forming method.

2. Related Art

With an increase in the demand for full color image forming apparatuses using electrophotography, high-speed color machines having high reliability have been requested. One of the factors for achieving the high reliability is a stable removing property of a toner which has remained on the surface of a photoreceptor without being transferred thereto.

SUMMARY

According to an aspect of the invention, there is provided an electrostatic-image-developing toner including: a polyester resin; two or more pigments; a polyethylene wax; and a polyolefin-polyvinyl-based graft copolymer, wherein the electrostatic-image-developing toner satisfies the relationship represented by the following equation (1):

$$0.2 \leq wd/wp \leq 5.0 \quad (1)$$

wherein wp represents a total content (wt. %) of the pigments, and wd represents a content (wt. %) of the polyolefin-polyvinyl-based graft copolymer.

BRIEF DESCRIPTION OF THE DRAWINGS

Exemplary embodiment(s) of the present invention will be described in detail based on the following figures, wherein:

FIG. 1 is a schematic structural view illustrating the image forming apparatus according to the present exemplary embodiment.

DETAILED DESCRIPTION

1. Electrostatic-Image-Developing Toner

The electrostatic-image-developing toner (which will hereinafter be called "toner" simply) according to the exemplary embodiment is characterized in that it contains a polyester resin, two or more pigments, a polyethylene wax, and a polyolefin-polyvinyl-based graft copolymer and satisfies the relationship of the following equation (1):

$$0.2 \leq wd/wp \leq 5.0 \quad (1)$$

wherein, wp represents the total content (wt. %) of the pigments and wd represents the content (wt. %) of the polyolefin-polyvinyl-based graft copolymer.

The electrostatic-image-developing toner according to the exemplary embodiment will hereinafter be described specifically. It is to be noted that the range of numerical values such as "A to B" has the same meaning as "A or more but B or less", in other words, it includes A and B unless otherwise particularly specified.

The electrostatic-image-developing toner according to the exemplary embodiment is suited for use in an image forming apparatus which is a superfast machine employing an optical fixing system (flash fixing system) and has a cleaning unit for scraping a residual toner, which has remained without being transferred, from the surface of an image holding member (photoreceptor) with a cleaning blade and suctioning and collecting the thus-scraped toner by using air.

When an image having a low coverage rate is repeatedly printed by using a superfast machine under a high humidity environment, due to deterioration in the conveyance of the toner removed by cleaning, the toner removal by using air conveyance cannot be performed sufficiently. As a result, image contamination problems caused by poor removal or curling of a cleaning blade may occur. Such a tendency is marked in toners containing a polyethylene wax therein.

As a result of intensive investigation on the collection efficiency of a toner, in a process of removing a toner with a cleaning blade and then collecting it in a toner collection box by air conveyance, particularly when a low coverage rate image is repeatedly printed out under a high humidity environment, it has been elucidated that a wax component liberated or eliminated from toner particles and present in the toner during collection deteriorates the toner collection efficiency.

It has been found by the present inventors that controlling the presence state of the pigment and wax enables to prevent elimination of the wax from toner particles and control the adhesion of an external additive and as a result, it becomes possible for the first time that stable air conveyance of a toner removed by cleaning can be achieved under the conditions of a low coverage rate and high humidity conditions.

It has also been found that by reducing elimination of the wax, adhesion between a toner and a photoreceptor can be controlled and stable toner collection efficiency can therefore be achieved. The mechanism of such findings are not necessarily clear, but are presumed to occur because of the following reasons.

The toner according to the exemplary embodiment contains, as a wax, a polyethylene wax and, as a binder resin, a polyester resin. The polyethylene wax is preferred because a fixed image having durability and scratch resistance can be obtained by using it. When the polyethylene wax is used, however, a wax component may be eliminated from the toner when it is exposed to a severe stress in a developing machine or from a cleaning member or the like because of having a high crystallization degree and poor compatibility with a polyester resin.

When the toner contains a polyolefin-polyvinyl-based graft copolymer and a wax, on the other hand, the polyolefin-polyvinyl-based graft copolymer has high affinity with the wax because a wax component has been grafted, which facilitates the wax to have a structure in which the wax has been dispersed in the toner while being enclosed in or in contact with the polyolefin-polyvinyl-based graft copolymer.

At this lime, it is important to employ two or more pigments different from each other, more specifically, at least one pigment uniformly dispersed in a binder resin and at least one pigment uniformly dispersed in the polyolefin-polyvinyl-based graft copolymer present locally in the vicinity of the wax.

Using two pigments, that is, a pigment dispersible in a polyester resin serving as a binder resin and a pigment dispersible in a vinyl resin present in the vicinity of the wax enables to realize toner particles having a high pigment concentration in the vicinity of the wax. Since the pigment is present in a high concentration in the vicinity of the wax, the resin in the vicinity of the wax is imparted with high elasticity so that elimination of the wax due to a stress from the outside can be prevented. It is difficult to obtain such a structure by using only one pigment.

When only a pigment dispersible in a polyester resin is used, the pigment in the vinyl resin such as polyolefin-polyvinyl-based graft copolymer in the vicinity of the wax is likely to cause aggregation, making it difficult to prevent elimination of the wax. When only a pigment dispersible in a vinyl resin in the vicinity of the wax is used, on the other hand, aggregation of the pigment in the vicinity of the wax occurs with flowing of the wax when the toner is melted at the time of fixing and it deteriorates the color development. Thus, using only one pigment is not preferred.

1. Polyester Resin

The electrostatic-image-developing toner according to the exemplary embodiment contains, as a binder resin, a polyester resin from the standpoints of high-speed fixing property and stress resistance of toner particles in a developing machine. The polyester resin is available by polycondensation of a carboxylic acid component and an alcohol component. As the carboxylic acid component and the alcohol component, conventionally known divalent, trivalent or higher polyvalent carboxylic acids and dihydric, trihydric, or higher polyhydric alcohols are usable, respectively.

Specific examples of the divalent carboxylic acid include aliphatic dicarboxylic acids such as maleic acid, fumaric acid, succinic acid, adipic acid, malonic acid, sebacic acid, mesaconic acid, and dodecenyl succinic acid (anhydride), and anhydrides and lower alkyl esters thereof; aromatic dicarboxylic acids such as phthalic acid, isophthalic acid, terephthalic acid, toluenedicarboxylic acid, and naphthalenedicarboxylic acid, and anhydrides and lower alkyl esters thereof; and alkyl or alkenyl succinic acids (anhydrides) having, on the side chain thereof, a $C_{4-35}$ hydrocarbon group [more specifically, dodecenyl succinic acid (anhydride), pentadodecenyl succinic acid (anhydride), and the like], and anhydrides and lower alkyl esters thereof.

Specific examples of the trivalent or higher polyvalent carboxylic acid include trimellitic acid, pyromellitic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, and 1,2,7,8-octanetetracarboxylic acid, and acid anhydrides and lower alkyl esters thereof. They may be used either singly or in combination.

Examples of the dihydric alcohol include $C_{2-12}$ alkylene glycols such as ethylene glycol, 1,2-propylene glycol, 1,3-propylene glycol, 1,4-butanediol, neopentyl glycol, 1,4-butenediol, 1,5-pentanediol, and 1,6-hexanediol, alkylene ether glycols such as diethylene glycol, triethylene glycol, dipropylene glycol, polyethylene glycol, polypropylene glycol, and polytetramethylene glycol, $C_{6-30}$ alicyclic diols such as 1,4-cyclohexanedimethanol and hydrogenated bisphenol A, bisphenols such as bisphenol A, bisphenol F, and bisphenol 5, and 2-8 mol alkylene oxide adducts of a bisphenol.

Examples of the trihydric or higher polyhydric alcohol include $C_{3-20}$ aliphatic polyhydric alcohols such as sorbitol, 1,2,3,6-hexanetetrol, 1,4-sorbitan, pentaerythritol, dipentaaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane, and $C_{6-20}$ aromatic polyhydric alcohols such as 1,3,5-trihydroxymethylbenzene, and alkylene oxide adducts thereof.

The polyester resin has a Tg (glass transition temperature) of preferably from 40° C. to 80° C. or from about 40° C. to about 80° C. and has a weight-average molecular weight of preferably from 5,000 to 100,000 or from about 5,000 to about 100,000.

As the binder resin, the polyester resin may be used in combination with a styrene/acrylic acid or methacrylic acid copolymer, a polyvinyl chloride resin, a phenolic resin, an acrylic resin, a methacrylic resin, polyvinyl acetate, a silicone resin, polyurethane, a polyamide resin, a furan resin, an epoxy resin, a xylene resin, polyvinyl butyral, a terpene resin, a coumarone-indene resin, a petroleum-based resin, a polyether polyol resin, or the like.

2. Pigment

The toner according to the exemplary embodiment contains at least two pigments as a coloring agent.

As the two pigments, two pigments different from each other, that is, a pigment uniformly dispersible in the polyester resin and a pigment dispersible in a polyolefin-polyvinyl-based graft copolymer present so as to enclose a polyethylene wax therein or to come into contact therewith are preferred. It is preferred that at least one is an azo pigment having, in the molecular structure thereof, at least one azo group and at least one is an azo-free pigment. It is more preferred that the azo pigment is dispersed uniformly in the polyester resin, while the azo-free pigment is dispersed in the polyolefin-polyvinyl-based graft copolymer and is present in the vicinity of the wax.

Specific examples of organic azo pigments for yellow color which are dispersed in the polyester resin side include monoazo pigments such as C.I. Pigment Yellow 1, 3, 62, 65, 74, 97, 111, 120, 151, 154, 167, 168, and 213; disazo pigments such as C.I. Pigment Yellow 12, 13, 14, 17, 55, 81, 83, 128, 155, and 180; and C.I. Pigment Yellow 93, 94, 95, and 166.

As the azo-free yellow pigments present in the vicinity of the wax, fused polycyclic pigments are especially preferred. The yellow pigment is more preferably an isoindoline pigment, an isoindolinone pigment, a quinophthalone pigment, or an anthraquinone pigment, with isoindoline pigments such as C.I. Pigment yellow 139 and 185, isoindolinone pigments such as C.I. Pigment Yellow 109, 110, and 173, quinophthalone pigments such as C.I. Pigment Yellow 138, and anthraquinone pigments such as C.I. Pigment Yellow 24, 108, and 199 being still more preferred.

Examples of the organic azo pigments for magenta color which are dispersed in the polyester resin side include insoluble azo pigments such as C.I. Pigment Red 1, 2, 3, 12, 21, 112, 114, 146, 166, 170, 184, 185, 187, 214, 220, 221, and 238 and soluble azo pigments such as C.I. Pigment red 48:1, 48:2, 48:3, 48:4, 49:1, 49:2, 49:3, 52:1, 53:1, 53:3, 57:1, 63:1, and 64:1.

As the magenta pigment present in the vicinity of the wax, fused polycyclic pigments for magenta color are preferred. Of these, quinacridone pigments, anthraquinone pigments, diketopyrropyrrole pigments, and perylene pigments are more preferred, with quinacridone pigments such as C.I. Pigment 122, 202, 206, 207, and 209 and C.I. Pigment Violet 19, anthraquinone pigments such as C.I. Pigment Red 168 and 177, and diketopyrrolopyrrole pigments such as C.I. Pigment red 254, 255, 264, and 272, and perylene pigments such as C.I. Pigment Red 123, 149, 178, 179, 190, and 224 being still more preferred.

Organic or inorganic pigments other than those described above, or dyes may be added as needed. The content wp of all the coloring agents in the toner is preferably from 1 wt. % to 12 wt. %, more preferably from 2 wt. % to 10 wt. %. When the content is within the above-described range, a sufficient coloring power can be achieved.

The content of the azo-containing pigment in the toner is preferably from 0.5 wt. % to 10 wt. % or from about 0.5 wt. % to about 10 wt. %, more preferably from 1 wt. % to 8 wt. % or from about 1 wt. % to about 8 wt. %, especially preferably from 1.5 wt. % to 7 wt. % or from about 1.5 wt. % to about 7 wt. %. The contents within the above-described range are preferred because a sufficient coloring power and color development property can be achieved.

The content of the azo-free pigment in the toner is preferably from 0.1 wt. % to 6 wt. % or from about 0.1 wt. % to about 6 wt. %, more preferably from 0.2 wt. % to 5 wt. % or from about 0.2 wt. % to about 5 wt. %, especially preferably from 0.3 wt. % to 4 wt. % or from about 0.3 wt. % to about 4 wt. %. The contents within the above-described range are preferred because they are effective for wax elimination prevention.

The electrostatic-image-developing toner according to the exemplary embodiment preferably satisfies the following equation (2):

$$0.05 \leq wp1/wp \leq 0.80 \quad (2)$$

wherein, wp1 represents the content (wt. %) of the azo-free pigment and wp represents the total content (wt. %) of the pigments.

When the wp1/wp ratio is 0.05 or greater, the wax elimination preventive effect is high. When the wp1/wp ratio is 0.80 or less, on the other hand, the pigments are dispersed sufficiently so that the resulting toner has an excellent color development property.

In the exemplary embodiment, the wp1/wp ratio is more preferably from 0.08 to 0.70, more preferably from 0.10 to 0.65.

3. Polyethylene Wax

The electrostatic-image-developing toner according to the exemplary embodiment contains, as a wax, a polyethylene wax. As the polyethylene wax, known ones are usable. More specifically, the polyethylene wax has, as a main structural unit thereof, an ethylene-derived structural unit and can be prepared in a known manner such as polymerization of ethylene in the presence of a radical catalyst or Ziegler catalyst or thermal decomposition of polyethylene. The term "the polyethylene wax has, as a main structural unit thereof, an ethylene-derived structural unit" means that the polyethylene wax contains the ethylene-derived structural unit in an amount of from 80 wt. % to 100 wt. %, more preferably from 90 wt. % to 100 wt. %, still more preferably 100 wt. %.

As well as unmodified polyethylene waxes, modified polyethylene waxes, for example, oxidized type polyethylene waxes obtained by oxidizing a polyethylene wax with oxygen in the air, acid-modified polyethylene waxes, that is, polyethylene waxes modified with a carboxylic acid such as acrylic acid, methacrylic acid, maleic acid, or fumaric acid, and styrene-monomer modified polyethylene waxes obtained by grafting a styrene compound to a polyethylene wax may be used.

The polyethylene wax has a weight average molecular weight of preferably 2000 or greater, more preferably 3000 or greater. Although no particular limitation is imposed, the upper limit of the weight-average molecular weight of the polyethylene wax is preferably 20,000 or less.

The polyethylene wax may be used in combination with known waxes. Examples of the waxes to be used in combination with the polyethylene wax include ester wax, polypropylene or polyethylene/polypropylene copolymer, polyglycerin wax, microcrystalline wax, paraffin wax, carnauba wax, sasol wax, montanic acid ester wax, deoxidized carnauba wax, unsaturated fatty acids such as palmitic acid, stearic acid, montanic acid, brassidic acid, eleostearic acid, and parinaric acid, saturated alcohols such as stearyl alcohol, aralkyl alcohol, behenyl alcohol, carnaubyl alcohol, ceryl alcohol, melissyl alcohol, and Long-chain alkyl-containing alcohols, polyhydric alcohols such as sorbitol, fatty acid amides such as linoleic acid amide, oleic acid amide, and lauric acid amide, saturated fatty acid bisamides such as methylenebisstearic acid amide, ethylenebiscapric acid amide, ethylenebislauric acid amide, and hexamethylenebisstearic acid amide, unsaturated fatty acid amides such as ethylenebisoleic acid amide, hexamethylenebisoleic acid amid; N,N'-dioleyladipic acid amide, and N,N'-dioleylcebasic acid amide, aromatic bisamides such as m-xylenebisstearic acid amide and N,N'-distearylisophthalic acid amide, fatty acid metal salts (generally so-called metal soaps) such as calcium stearate, calcium laurate, zinc stearate, and magnesium stearate, partially esterified products of a fatty acid and a polyhydric alcohol such as behenic acid monoglyceride; and hydroxyl-containing methyl ester compounds obtained by hydrogenating vegetable oil and fats.

Here, as the wax to be contained in the toner of the exemplary embodiment, a wax material having an endothermic peak in a temperature range of from 50° C. to 160° C. or from about 50° C. to about 160° C. in DSC measurement (differential scanning type calorimetry) is preferred. In the above DSC measurement, it is preferred to measure using an inner heat input compensation type differential scanning calorimeter with high accuracy in light of a measuring principle.

The content of all the wax components in the toner is preferably from 0.5 wt. % to 15 wt. %, more preferably from 1 wt. % to 10 wt. %.

The content of the polyethylene wax in the toner is preferably from 0.5 wt. % to 8 wt. % or from about 0.5 wt. % to about 8 wt. %, more preferably from 1 wt. % to 6 wt. % or from about 1 wt. % to about 6 wt. %, still more preferably from 1.5 wt. % to 5 wt. % or from about 1.5 wt. % to about 5 wt. %.

4. Polyolefin-Polyvinyl-Based Graft Copolymer

The electrostatic-image-developing toner according to the exemplary embodiment contains a polyolefin-polyvinyl graft copolymer.

As the polyolefin-polyvinyl-based graft copolymer, using a vinyl resin having a polyolefin grafted thereon is preferred. Grafting of a polyolefin, which is a wax, on a vinyl-based resin structure facilitates presence of the vinyl resin having a polyolefin grafted thereon on an interface between the binder resin and the wax.

Examples of the vinyl resin constituting the polyolefin-polyvinyl-based graft copolymer include copolymers of a styrene monomer and a (meth)acrylic monomer.

Examples of the styrene monomer include styrene and alkylstyrenes (such as α-methylstyrene and p-methylstyrene).

Examples of the (meth)acrylic monomer include alkyl (meth)acrylates having a $C_{1-18}$ alkyl group such as methyl (meth)acrylate, ethyl (meth)acrylate, butyl (meth)acrylate, 2-ethylhexyl (meth)acrylate, lauryl (meth)acrylate, and stearyl (meth)acrylate; hydroxyl-containing (meth)acrylates such as hydroxyethyl (meth)acrylate and hydroxypropyl (meth)acrylate, amino-containing (meth)acrylates such as dimethylaminoethyl (meth)acrylate, and (meth)acrylic acid.

When a polyester resin is used as the binder resin, an unsaturated nitrile monomer such as (meth)acrylonitrile or cyanostyrene, an unsaturated carboxylic acid such as maleic acid or fumaric acid, or anhydride thereof, or an unsaturated carboxylic acid monoester such as monomethyl maleate or monobutyl maleate may be used in combination with the styrene monomer or (meth)acrylic monomer from the standpoint of compatibility.

As the polyolefin, usable are polymers of one or more monomers selected from ethylene, propylene, butene-1, pentene-1, hexane-1, heptene-1, octene-1, nonene-1, and decene-1, and isomers thereof different in the position of an unsaturated bond, and olefins having a branched chain composed of an alkyl group such as 3-methyl-1-butene, 3-methyl-2-pentene, and 3-propyl-5-methyl-2-hexene.

As well as unmodified polyolefins, modified polyolefins, for example, oxidized type polyolefins obtained by oxidizing a polyolefin with oxygen in the air, acid-modified polyolefins, that is, polyolefins modified with a carboxylic acid such as acrylic acid, methacrylic acid, maleic acid, or fumaric acid, and styrene monomer modified polyolefins obtained by grafting a styrene compound on a polyolefin may be used.

The polyolefin-polyvinyl-based graft copolymers can be obtained by dissolving a polyolefin in a solvent such as toluene or xylene, adding a vinyl monomer to the resulting solution under heating to cause polymerization, and then removing the solvent.

The polyolefin-polyvinyl-based graft copolymer is contained in an amount of preferably from 0.5 wt. % to 15 wt. %, more preferably from 0.8 wt. % to 12 wt. %, especially preferably from 1 wt. % to 10 wt. % based on 100 wt. % of the total solid content of the toner.

The polyolefin-polyvinyl-based graft copolymer has a Tg (glass transition temperature) of preferably from 40° C. to 80° C. or from about 40° C. to about 80° C. The temperatures within the above range are preferred because the good heat storage property and fixing property of the resulting toner can be maintained.

The polyolefin-polyvinyl-based graft copolymer has a weight-average molecular weight of preferably from 3,000 to 50,000 or from about 3,000 to about 50,000. The weight-average molecular weights within the above range are preferred because they permit uniform dispersion of the wax.

5. Equation (1)

The electrostatic-image-developing toner according to the exemplary embodiment satisfies the following equation (1):

$$0.2 \leq wd/wp \leq 5.0 \quad (1)$$

wherein, wp represents the total content (wt. %) of the pigments and wd represents the content (wt. %) of the polyolefin-polyvinyl-based graft copolymer.

The wd/wp ratios smaller than 0.20 may lead to elimination of the wax. The wd/wp ratios exceeding 5.0, on the other hand, may lead to deterioration of pigment dispersion, resulting in deterioration in color development property and transparency.

The wd/wp ratio is preferably from 0.25 to 4.0, more preferably from 0.30 to 3.5. When the wd/wp ratios are within the above range, the pigment dispersion in the toner and presence state of the pigment in the vicinity of the wax are controlled suitably and as a result, a wax elimination preventive effect can be achieved without impairing the color development property.

The electrostatic-image-developing toner according to the exemplary embodiment preferably satisfies the following equation (1'):

$$0.5 \leq wd/wp1 \leq 15 \quad (1')$$

wherein, wp1 represents the content (wt. %) of the azo-free pigment and wd represents the content (wt. %) of the polyolefin-polyvinyl-based graft copolymer.

When the wd/wp1 ratio is 0.5 or greater, the wax elimination preventive effect is high because the presence state of the azo-free pigment is controlled effectively. When the wd/wp1 ratio is 15 or less, on the other hand, the azo-containing pigment is dispersed sufficiently and the resulting toner has an excellent color development property.

The wd/wp1 ratio is preferably from 0.7 to 12, more preferably from 0.8 to 10.

6. Other Additives (External Additive)

Examples of external additives include inorganic particles such as silica powder, alumina, titanium oxide, barium titanate, magnesium titanate, calcium titanate, strontium titanate, zinc oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. The toner containing at least one of silica, titanium oxide, and alumina is especially preferred. In addition, metal salts of a higher fatty acid such as zinc stearate and organic particles composed of, for example, a vinyl polymer such as styrene polymer, (meth)acrylic polymer, or ethylene polymer, a polymer such as ester polymer, melamine polymer, amide polymer, or allyl phthalate polymer, a fluorine polymer such as vinylidene fluoride, or a higher alcohol may be added.

The external additive, together with a desired additive if necessary, may be sufficiently mixed in a mixer such as Henschel mixer and the resulting mixture may be externally add to the toner.

The external additive is externally added to the toner particles, which have not yet contained the external additive, in an amount of from 0.01 part by weight to 5 parts by weight, more preferably from 0.1 part by weight to 3.0 parts by weight based on 100 parts by weight of the toner particles.

(Charge Controlling Agent)

The electrostatic-charge-developing toner according to the exemplary embodiment may contain a charge controlling agent as needed and as the charge controlling agent, known ones are usable.

No particular limitation is imposed on the charge controlling agent and known ones can be used depending on the using purpose. Examples of positively chargeable charge controlling agents include nigrosine dyes; onium salts such as quaternary ammonium salts, e.g., tributylbenzylammonium-1-hydroxy-4-naphthosulfonate and tetrabutylammonium teterafluoroborate, and phosphonium salts which are analogs thereof, and lake pigments of these salts; triphenylmethane dyes; metal salts of a higher fatty acid; diorganotin oxides such as dibutyltin oxide, dioctyltin oxide, and dicyclohexyltin oxide; diorganotin borates such as dibutyltin borate; guanidine compounds; imidazole compounds; and aminoacrylic resins.

Examples of negatively chargeable charge controlling agents include heavy-metal-containing acid dyes such as trimethylethane dyes, metal complex salts of salicylic acid, metal complex salts of benzylic acid, copper phthalocyanine, perylene, quinacridone, azo pigments, metal complex salt azo dyes, and azochromium complexes, calixarene type phenolic condensates, cyclic polysaccharides, and carboxyl- and/or sulfonyl-containing resins. These charge controlling agents may be used either singly or in combination.

(Infrared Absorbing Material)

When the electrostatic-image-developing toner according to the exemplary embodiment is used in an image forming device employing an optical fixing system, it may contain an infrared absorbing material.

As the infrared absorbing material usable in the exemplary embodiment, known infrared absorbing materials are usable. Examples include cyanine compounds, merocyanine compounds, benzene-thiol metal complexes, mercaptophenol metal complexes, aromatic diamine metal complexes, diimmonium compounds, aminum compounds, nickel complex compounds, phthalocyanine compounds, anthraquinone compounds, and naphthalocyanine compounds.

Specific examples of the infrared absorbing material include nickel metal complex infrared absorbing materials ("SIR-130", "SIR-132", each, trade name; product of Mitsui Chemicals), bis(dithiobenzyl)nickel ("MIR-101", trade name, product of Midori Kagaku), bis[1,2-bis(p-methoxyphenyl)-1,2-ethylenedithiolate]nickel ("MIR-102", trade name, product of Midori Kagaku), tetra-n-butylammonium-bis(cis-1,2-diphenyl-1,2-ethylenedithiolate)nickel ("MIR-1011", trade name, product of Midori Kagaku), tetra-n-butylammoniumbis[1,2-bis(p-methoxyphenyl)-1,2-ethylenedithiolate]-nickel ("MIR-1021", trade name, product of Midori Kagaku), bis(4-tert-1,2-butyl-1,2-dithiophenolate)nickel-tetra-n-butylammonium ("BBDT-NI", trade name; product of Sumitomo Seika Chemicals), cyanine infrared absorbing materials ("IRF-106", "IRE-107", each, trade name; product of FUJIFILM), cyanine infrared absorbing materials ("YKR2900", trade name; product of YAMAMOTO CHEMICALS), aminium and diimmonium infrared absorbing materials ("NIR-AM1", and "NIR-IM1", each, trade name; product of Nagase ChemteX), immonium compounds ("CIR-1080" and "CIR-1081", each, trade name; product of Japan Carlit), aminium compounds ("CIR-960" and "CIR-961", each, trade name; product of Japan Carlit), anthraquinone compounds ("IR-750", trade name; product of Nippon Kayaku), aminium compounds ("IRG-002", "IRG-003", and "IRG-003K, each, trade name; product of Nippon Kayaku), polymethine compounds ("IR-820B", trade name; product of Nippon Kayaku), diimmonium compounds ("IRG-022" and "IRG-023", each, trade name; product of Nippon Kayaku), cyanine compounds ("CY-2", "CY-4", and "CY-9", each, trade name; product of Nippon Kayaku), soluble phthalocyanine ("TX-305A", trade name; product of NIPPON SHOKUBAI), naphthalocyanines ("YKR5010", trade name; product of YAMAMOTO CHEMICALS, "Sample 1", product of Sanyo Color Works), and inorganic materials ("Ytterbium UU-HP", trade name; product of Shin-Etsu. Chemical and indium tin oxide, product of Sumitomo Metal Industries).

7. Production Process of Electrostatic-Charge-Developing Toner

The electrostatic-image-developing toner according to the exemplary embodiment can be produced in a known production process such as melting and pulverizing process, suspension polymerization process, emulsion aggregation process, or dissolution suspension process.

When the kneading and pulverizing process is employed, the above-described components such as binder resin, wax, charge controlling agent, and coloring agent are mixed and then, the resulting mixture is melted and kneaded in a kneader, extruder, or the like. Then, the resulting melt kneaded mass is roughly pulverized, followed by fine pulverization in a jet mill. By treating them with an air separator, toner particles having a desired particle size can be obtained. An external additive is then added to the resulting toner particles if necessary, whereby the electrostatic-charge-developing toner according to the exemplary embodiment can be obtained.

The toner particles have a volume-average particle size of preferably from 4 μm to 12 μm.

The volume-average particle size of the toner particles can be measured using, for example, "Coulter Multisizer II" (trade name; product of Beckman Coulter). Described specifically, from 0.5 mg to 50 mg of a sample to be measured is added to a surfactant serving as a dispersant and then, the resulting mixture is added to from 100 ml to 150 ml of an electrolyte. The electrolyte in which the sample has been suspended is dispersed for one minute by an ultrasonic dispersing machine and a particle size distribution of particles having a particle size within a range of from 2.0 μm to 60 μm is measured using the "Coulter Counter II" and an aperture having an aperture diameter of 100 μm. The number of particles to be measured is 50,000. The particle size distribution of the toner particles thus measured is divided into particle size ranges (channels) and a cumulative distribution curve is drawn from the side of smaller particles. On the curve, the particle size giving an accumulation of 50% is defined as a volume-average particle size $D_{50}$.

II. Electrostatic Charge Developer

The electrostatic charge developer (which may hereinafter be called "developer", simply) according to the exemplary embodiment is characterized in that it contains the electrostatic-charge-developing toner according to the exemplary embodiment and a carrier.

The developer according to the exemplary embodiment may be one-component developer composed of the toner of the exemplary embodiment or a two-component developer composed of a carrier and the toner of the exemplary embodiment, but the two-component developer is preferred. Next, description will be made specifically on the case where the developer of the exemplary embodiment is a two-component developer.

No particular limitation is imposed on the carrier to be used for the two-component developer and known carriers are usable. Examples include resin-coated carriers having, on the surface of the core material thereof, a resin coating layer. The carrier may be a resin-dispersed type one obtained by dispersing a conductive material or the like in the matrix resin. As magnetic particles which will be the core material, ferrite, magnetite, iron powder, and the like are usable.

The carrier can be obtained by coating a resin to the core material by spray dry method, rotary dry method, or liquid immersion dry method with a universal stirrer.

Examples of the resin to be used for coating the surface of the core material include fluorine resins, acrylic resins, epoxy resins, polyester resins, fluoroacrylic resins, acrylic/styrene resins, silicone resins, silicone resins modified with resins such as an acrylic, polyester, epoxy, alkyd, or urethane resin, and crosslink type fluorine-modified silicone resins. If necessary, a charge controlling agent, a resistance controlling agent, or the like may be added to the carrier as needed.

The carrier has an average particle size of preferably from 20 μm to 100 μm, more preferably from 30 to 80 μm.

The two-component developer may be produced by mixing the toner with the carrier. In the developer, the toner and the carrier are mixed at a ratio (toner:carrier weight ratio) of preferably from 1:99 to 20:80, more preferably from 3:97 to 12:88.

III. Image Forming Apparatus and Image Forming Method

The image forming apparatus according to the exemplary embodiment is a superfast machine whose developer holding member has a peripheral speed of 1,000 mm/s or greater, or about 1,000 mm/s or greater. It has a mechanism of suctioning and collecting a toner, which has been removed with a cleaning blade, by utilizing an air stream. The electrostatic-image-developing toner according to the exemplary embodiment is collected efficiently because it does not cause elimination of a wax even under high speed printing at a peripheral speed of a developer holding member of 1,000 mm/s or greater, or about 1,000 mm/s or greater so that the toner does not attach to the image holding member during cleaning.

More specifically, the image forming apparatus of the exemplary embodiment has an image holding member, a charging unit for charging the surface of the image holding member, an electrostatic latent image forming unit for forming an electrostatic latent image on the surface of the image holding member, a developing unit for developing the electrostatic latent image with a toner-containing developer into a toner image, a transfer unit for transferring the toner image to a transfer-receiving material, a fixing unit for fixing the transferred toner image to the transfer-receiving material in accordance with an optical fixing system, and a cleaning unit for removing the toner which has remained on the surface of the image holding member without being transferred. The image forming apparatus is characterized in that the developer holding member for holding the developer has a peripheral speed of 1,000 mm/s or greater, or about 1,000 mm/s or greater; the cleaning unit has a mechanism of suctioning and collecting the toner, which has been removed using a cleaning blade, by utilizing an air stream; and the toner is the electrostatic-image-developing toner according to the exemplary embodiment or the developer is the electrostatic image developer according to the exemplary embodiment.

The image forming method according to the exemplary embodiment has a charging step for charging the surface of an image holding member, an electrostatic latent image forming step for forming an electrostatic latent image on the surface of the image holding member, a developing step for developing the electrostatic latent image into a toner image by using a toner-containing developer, a transfer step for transferring the toner image to a transfer-receiving material, a fixing step for fixing the transferred toner image to the transfer-receiving material in accordance with an optical fixing system, and a cleaning step for removing the toner which has remained on the surface of the image holding member without being transferred. The method is characterized in that a developer holding member for holding the developer has a peripheral speed of 1,000 mm/s or greater, or about 1,000 mm/s or greater; the cleaning step is a step of suctioning and collecting the toner, which has been removed using a cleaning blade, by utilizing an air stream; and the toner is the electrostatic-image-developing toner according to the exemplary embodiment or the developer is the electrostatic image developer according to the exemplary embodiment.

Image formation by using the image forming apparatus is performed, when a photoreceptor is used as the image holding member, by charging the surface of the image holding member by using a charging unit such as corotron charger or contact charger, exposing to form an electrostatic latent image, bringing it close to or in contact with a developer holding member having, on the surface thereof, a developer layer to attach a toner to the electrostatic latent image, forming a toner image on the photoreceptor, transferring the toner image to the surface of a transfer-receiving material such as paper by making use of a corotron charger or the like, and fixing the toner image transferred to the transfer-receiving material by using a fixing device.

(Image Holding Member)

Examples of the photoreceptor serving as the image holding member include inorganic photoreceptors such as amorphous silicon and selenium and organic photoreceptors using polysilane, phthalocyanine, or the like as a charge generating material or charge transport material. Of these, an amorphous photoreceptor having a long operating life is preferred.

Since the amorphous silicon photoreceptor has a particularly high surface hardness, a large stress is imposed on toner particles during cleaning. Conventional toners are apt to cause elimination of a wax, but the electrostatic-image-developing toner of the exemplary embodiment does not cause elimination of a wax so that it is suited for use even in an image forming apparatus using an amorphous silicon photoreceptor.

The image holding member may be equipped with a heating mechanism. The temperature of the surface of the image holding member is preferably from 20° C. to 60° C., more preferably from 25° C. to 55° C., still more preferably from 30° C. to 50° C. The temperatures within the above range are preferred because they can prevent image deletion due to attachment of discharge products to the image holding member.

(Developing Unit)

The image forming apparatus according to the exemplary embodiment has a developing unit for developing the electrostatic latent image into a toner image by using a toner-containing developer. The developer may be either a one component developer or a two-component developer, but the two-component developer is preferred.

In the image forming apparatus according to the exemplary embodiment, the developer holding member for holding the developer has a peripheral speed of 1,000 mm/s or greater, or about 1,000 mm/s or greater. When the electrostatic-image-developing toner of the exemplary embodiment is used as a developer, the wax is not eliminated from the toner even if the peripheral speed of the developer holding member is set at 1,000 mm/s or greater so that deterioration in cleaning property or collection efficiency does not occur.

The peripheral speed of the developer holding member is preferably from 1,000 mm/s to 2,000 mm/s or from about 1,000 mm/s to about 2,000 mm/s, more preferably from 1,000 mm/s to 1,500 mm/s or from about 1,000 mm/s to about 1,500 mm/s.

(Transfer Unit)

The image forming apparatus of the exemplary embodiment has a transfer unit for transferring the toner image to a transfer-receiving material.

The transfer of the toner image may be carried out by a system in which the image is transferred directly from the image holding member to a transfer-receiving material such as paper, but it may be carried out by an intermediate transfer system in which primary transfer of the toner image from the surface of the image holding member to the surface of an intermediate transfer-receiving material is followed by secondary transfer from the surface of the intermediate transfer-receiving material to the surface of a transfer-receiving material such as paper.

(Fixing Unit)

As the fixing unit, a fixing unit for fixing the transferred toner image to the surface of a transfer-receiving material in accordance with an optical fixing system is preferred. When the electrostatic-image-developing toner of the exemplary embodiment is used, an optical fixing device (flash fixing device) is employed.

Examples of a light source to be used for the optical fixing device include halogen lamps, mercury lamps, xenon flash lamps, and infrared laser. The xenon flash lamp is most suited because it can save energy by carrying out instant fixing. The xenon flash lamp has a light emission energy within a range of preferably from 1.0 J/cm$^2$ to 7.0 J/cm$^2$, more preferably from 2 J/cm$^2$ to 5 J/cm$^2$.

The light emission energy of flash light per unit area indicating the intensity of the xenon lamp is represented by the following equation (3):

$$S=((1/2)\times C\times V^2)/(u\times L)\times(n\times f) \quad (3)$$

wherein, n is the number of lamps lighted simultaneously, f is a lighting frequency (Hz), V is an input voltage (V), C is a capacitance of a capacitor (F), u is a traveling speed of the process (ends), L is an effective emission width (usually, maximum paper width, cm) of the flash lamp, and S is an energy density ($J/cm^2$).

The optical fixing system employed here is preferably a delayed system in which two or more xenon flash lamps are caused to emit light with a time lag. In this delayed system, two or more flash lamps are arranged and the same position is exposed to light two or more times by causing the lamps to emit light with a time lag of from about 0.01 ms to 100 ms. This enables to supply a light energy to a toner image not by one emission but by emission in fractions so that fixing can be conducted under milder conditions and both void resistance and fixing property can be satisfied. When the toner image is subjected to flash light emission two or more times, the light emission energy of the flash lamps is a total amount of light emission energies given to the unit area per light emission.

The number of xenon flash lamps is within a range of preferably from one to 20, more preferably from 2 to 10. The time lag between two of the xenon flash lamps is within a range of from 0.1 msec to 20 msec, more preferably from 1 msec to 3 msec.

Additionally, the light emission energy of one light emission of the xenon flash lamp is within a range of preferably from 0.1 $J/cm^2$ to 1 $J/cm^2$, more preferably from 0.4 $J/cm^2$ to 0.8 $J/cm^2$.

(Cleaning Unit)

The image forming apparatus of the exemplary embodiment has a cleaning unit for removing the toner which has remained on the surface of the image holding member without being transferred. The cleaning unit has a mechanism of suctioning and collecting the toner, which has been removed using a cleaning blade, by utilizing an air stream. A device having the cleaning blade and the mechanism of suctioning and collecting the toner by utilizing an air stream is called "a cleaning device", collectively.

One embodiment of the cleaning device is a cleaning device having a cleaning blade that can be brought into contact with the surface of the image holding member, a holding member for holding the cleaning blade, a supporting member for supporting the holding member in such a manner as to bring the cleaning blade into contact with the surface of the image holding member in order to remove the residual toner attached to the surface of the image holding member, and a suctioning and transporting unit placed to cover the cleaning blade for suctioning and transporting the residual toner removed by the cleaning blade. The toner thus suctioned is collected in a toner bottle.

The image forming apparatus and image forming method according to the exemplary embodiment will next be described referring to FIG. 1. FIG. 1 is a schematic view illustrating one example of the image forming apparatus. The apparatus illustrated in FIG. 1 is that for forming a toner image with cyan, magenta, and yellow toners as well as a black toner.

In FIG. 1, indicated by 1*a* to 1*d* are charging units, 2*a* to 2*d* are exposure units, 3*a* to 3*d* are photoreceptors (image holding members), 4*a* to 4*d* are developing units, 10 is recording paper (transfer-receiving material) to be sent from a roll medium 15 in the arrow direction, 20 is a cyan developing device, 30 is a magenta developing device, 40 is a yellow developing device, 50 is a black developing device, 70*a* to 70*d* are transfer rolls (transfer units), 71 and 72 are rolls, 80 is a transfer voltage supply unit, and 90 is an optical fixing device (fixing unit).

The image forming apparatus illustrated in FIG. 1 is comprised of the developing devices for respective colors represented by numerals 20, 30, 40, and 50 and including the charging unit, the exposure unit, the photoreceptor, and the developing unit; the rolls 71 and 72 placed contiguous to the recording paper 10 for transporting the recording paper 10, the transfer rolls 70*a*, 70*b*, 70*c*, and 70*d* placed opposite to the photoreceptors of the developing devices with the recording paper 10 therebetween and pressing the photoreceptors, the transfer voltage supply unit 80 for supplying a voltage to these four transfer rolls, and the optical fixing device (fixing unit) 90 for irradiating light to the photoreceptor-contact side of the recording paper 10 that travels through a nip portion between the photoreceptors and the transfer rolls in the direction of an arrow indicated in FIG. 1.

In the cyan developing device 20, the charging unit 1*a*, the exposure unit 2*a*, and the developing unit 4*a* are placed clockwise around the photoreceptor 3*a*. In addition, the transfer roll 70*a* is placed opposite to the photoreceptor 3*a* with the recording paper 10 therebetween so that it comes into contact with the surface of the photoreceptor 3*a* in a region rotated in clockwise direction between the positions, placed on the photoreceptor 3*a*, of the developing unit 4*a* and the charging unit 1*a*. The other developing devices for toners different in color also have the same constitution. The cleaning device (not illustrated) having a cleaning blade and a mechanism for suctioning and collecting the residual toner removed with the cleaning blade is placed between the transfer roll 70*a* and the exposure unit 2*a*. The other developing devices also have the same constitution. In the image-forming apparatus according to the exemplary embodiment, the developing unit 4*a* in the cyan developing device 20 is loaded with a developer containing the above-described cyan toner and the developing units of the other developing devices are respectively loaded with optically fixing toners corresponding to the respective colors.

Image formation using the image-forming apparatus will next be described. First, the surface of the photoreceptor 3*d* is charged uniformly by using the charging unit 1*d* while rotating the photoreceptor 3*d* in the clockwise direction in the black developing device 50. A latent image corresponding to the black component image of an original image to be copied is then formed on the surface of the photoreceptor 3*d* by exposing the surface of the charged photoreceptor 3*d* to the exposure unit 2*d*. Then, a black toner loaded in the developing unit 4*d* is given to the resulting latent image, followed by development to form a black toner image. The same procedure also proceeds in the yellow developing device 40, the magenta developing device 30, and the cyan developing device 20 and toner images in respective colors are formed on the photoreceptor surfaces of respective developing devices.

The respective toner images formed on the photoreceptor surface are transferred successively onto the recording paper 10 that travels in the direction of an arrow through the action of transfer potential from the transfer rolls 70*a* to 70*d* and stacked on the surface of the recording paper 10 to correspond to the original image information, whereby a full-color toner image obtained by stacking cyan, magenta, and yellow in the order of mention from the top layer is formed.

Then, the stacked toner image on the recording paper 10 is conveyed to the optical fixing device 90. The stacked toner image is then melted by exposure to light from the optical fixing device 90 and optically fixed to the recording paper 10 to form a full color image.

The invention will hereinafter be described by Examples. It should however be borne in mind that the invention is not limited to or by these Examples. All designations of "part" or "parts" and "%" mean part or parts by weight and wt. % unless otherwise specifically indicated.

Example 1

(Preparation of Polyolefin-Polyvinyl-Based Graft Copolymer 1)

A 2 L stainless steel pressure reactor is charged with 80 parts of xylene, 10 parts of a polyethylene wax ("200P", trade name; product of Mitsui Chemical), and 5 parts of a polypropylene wax ("NP105", trade name; product of Mitsui Chemical). After the reactor is purged sufficiently with nitrogen, polymerization is conducted by adding dropwise thereto a mixture of 68 parts of styrene, 7 parts of acrylonitrile, 10 parts of n-butyl acrylate, 1 part of di-t-butyl peroxide, and 20 parts of xylene at 170° C. The reaction product is then retained for 30 minutes. The solvent is removed from the resulting solution to obtain a polyolefin-polyvinyl-based graft copolymer 1 (a styrene-acrylonitrile-butyl acrylate copolymer having a polyethylene wax and a polypropylene wax grafted thereon, Tg: 57° C., weight average molecular weight: 8,000).

(Preparation of Yellow Toner 1)

| | |
|---|---|
| Polyester resin 1 (polyester resin composed mainly of propylene oxide adduct/ethylene oxide adduct of bisphenol A, terephthalic acid, and trimellitic acid) | 85.0 parts |
| Yellow pigment 1 (C.I. Pigment Yellow 155, disazo pigment: product of Clariant) | 4.0 parts |
| Yellow pigment 2 (C.I. Pigment Yellow 139, isoindoline pigment; product of Clariant) | 1.0 part |
| Polyethylene wax 1 ("400P", trade name; product of Mitsui Chemical) | 3.0 parts |
| Polyolefin-polyvinyl-based graft copolymer 1 | 5.5 parts |
| Charge controlling agent 1 (quaternary ammonium salt, "BONTRON P-51", trade name; product of Orient Chemical Industries) | 1.0 part |
| Infrared absorbing material 1 (diimonium compound, "IRG-022", trade name; product of Nippon Kayaku) | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 1 having a volume average particle size $D_{50}$ of 7.5 μm.

Further, 100 parts of the yellow toner mother particle 1 and 0.7 part of hydrophobic silica ("RA200H", trade name; product of Nippon Aerosil) are mixed in a Henschel mixer to obtain a yellow toner 1.

Then, a resin coat carrier (volume average particle size of 50 μm) obtained by coating ferrite particles with a styrene-methyl methacrylate copolymer and the yellow toner 1 are mixed at a carrier:toner weight ratio of 94:6 to prepare the yellow developer 1.

Example 2

(Preparation of Magenta Toner 1)

| | |
|---|---|
| Polyester resin 1 | 82.5 parts |
| Magenta pigment 1 (C.I. Pigment Red 238, naphthol AS type azo pigment, product of Sanyo Color Works) | 4.5 parts |
| Magenta pigment 2 (C.I. Pigment Red 122, quinacridone pigment; product of Dainichiseika Color & Chemicals) | 1.5 parts |
| Polyethylene wax 1 | 3.0 parts |
| Polyolefin-polyvinyl-based graft copolymer 1 | 7.0 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a magenta toner mother particle 1 having a volume average particle size $D_{50}$ of 7.5 μm.

Further, 100 parts of the magenta toner mother particle 1 and 0.7 part of hydrophobic silica ("RA200H", trade name; product of Nippon Aerosil) are mixed in a Henschel mixer to obtain a magenta toner 1.

Then, a resin coat carrier (volume average particle size of 50 μm) obtained by coating ferrite particles with a styrene-methyl methacrylate copolymer and the magenta toner 1 are mixed at a carrier:toner weight ratio of 94:6 to prepare a magenta developer 1.

Example 3

(Preparation of Yellow Toner 2)

| | |
|---|---|
| Polyester resin 1 | 89.5 parts |
| Yellow pigment 1 | 4.0 parts |
| Yellow pigment 2 | 1.0 part |
| Polyethylene wax 1 | 3.0 parts |
| Polyolefin-polyvinyl-based graft copolymer 1 | 1.0 part |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 2 having a volume average particle size $D_{50}$ of 7.5 μm.

Further, 100 parts of the yellow toner mother particle 2 and 0.7 part of hydrophobic silica ("RA200H", trade name; product of Nippon Aerosil) are mixed in a Henschel mixer to obtain a yellow toner 2. Then, the resulting toner is mixed with a carrier as in Example 1 to prepare a yellow developer 2.

Example 4

(Preparation of Yellow Toner 3)

| | |
|---|---|
| Polyester resin 1 | 80.5 parts |
| Yellow pigment 1 | 1.8 parts |
| Yellow pigment 2 | 1.2 parts |
| Polyethylene wax 1 | 2.5 parts |
| Polyolefin-polyvinyl-based graft copolymer 1 | 12.5 parts |

-continued

| | |
|---|---|
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 3 having a volume average particle size $D_{50}$ of 8.7 μm.

Further, 100 parts of the yellow toner mother particle 3 and 0.7 part of hydrophobic silica ("RA200H", trade name; product of Nippon Aerosil) are mixed in a Henschel mixer to obtain a yellow toner 3. Then, the resulting toner is mixed with a carrier as in Example 1 to prepare a yellow developer 3.

Example 5

(Preparation of Yellow Toner 4)

| | |
|---|---|
| Polyester resin 1 | 89.2 parts |
| Yellow pigment 1 | 4.0 parts |
| Yellow pigment 2 | 0.2 part |
| Polyethylene wax 1 | 3.0 parts |
| Polyolefin-polyvinyl-based graft copolymer 1 | 2.1 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 4 having a volume average particle size $D_{50}$ of 8.0 μm.

Further, 100 parts of the yellow toner mother particle 4 and 0.7 part of hydrophobic silica ("RA200H", trade name; product of Nippon Aerosil) are mixed in a Henschel mixer to obtain a yellow toner 4. Then, the resulting toner mixed with a carrier as in Example 1 to prepare a yellow developer 4.

Example 6

(Preparation of Yellow Toner 5)

| | |
|---|---|
| Polyester resin 1 | 82.5 parts |
| Yellow pigment 1 | 1.0 part |
| Yellow pigment 2 | 4.0 parts |
| Polyethylene wax 1 | 3.0 parts |
| Polyolefin-polyvinyl-based graft copolymer 1 | 8.0 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 5 having a volume average particle size $D_{50}$ of 7.5 μm.

Further, 100 parts of the yellow toner mother particle 5 and 0.7 part of hydrophobic silica ("RA200H", trade name; product of Nippon Aerosil) are mixed in a Henschel mixer to obtain a yellow toner 5. Then, the resulting toner is mixed with a carrier as in Example 1 to prepare a yellow developer 5.

Comparative Example 1

(Preparation of Yellow Toner 6)

| | |
|---|---|
| Polyester resin 1 | 90.5 parts |
| Yellow pigment 1 | 4.0 parts |
| Yellow pigment 2 | 1.0 part |
| Polyethylene wax 1 | 3.0 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 6 having a volume average particle size $D_{50}$ of 7.5 μm.

Further, 100 parts of the yellow toner mother particle 6 and 0.7 part of hydrophobic silica ("RA200H", trade name; product of Nippon Aerosil) are mixed in a Henschel mixer to obtain a yellow toner 6. Then, the resulting toner mixed with a carrier as in Example 1 to prepare a yellow developer 6.

Comparative Example 2

(Preparation of Yellow Toner 7)

| | |
|---|---|
| Polyester resin 1 | 85.0 parts |
| Yellow pigment 1 | 5.0 parts |
| Polyethylene wax 1 | 3.0 parts |
| Polyolefin-polyvinyl-based graft copolymer 1 | 5.5 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 7 having a volume average particle size $D_{50}$ of 7.5 μm.

Further, 100 parts of the yellow toner mother particle 7 and 0.7 part of hydrophobic silica ("RA200H", trade name; product of Nippon Aerosil) are mixed in a Henschel mixer to obtain a yellow toner 7. Then, the resulting toner is mixed with a carrier as in Example 1 to prepare a yellow developer 7.

Comparative Example 3

(Preparation of Magenta Toner 2)

| | |
|---|---|
| Polyester resin 1 | 85.0 parts |
| Magenta pigment 2 | 5.0 parts |
| Polyethylene wax 1 | 3.0 parts |
| Polyolefin-polyvinyl-based graft, copolymer 1 | 5.5 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a magenta toner mother particle 2 having a volume average particle size $D_{50}$ of 7.5 μm.

Further, 100 parts of the magenta toner mother particle 2 and 0.7 part of hydrophobic silica ("RA200H", trade name; product of Nippon Aerosil) are mixed in a Henschel mixer to obtain a magenta toner 2. Then, the resulting toner is mixed with a carrier as in Example 1 to prepare a magenta developer 2.

Comparative Example 4

(Preparation of Yellow Toner 8)

| | |
|---|---|
| Polyester resin 1 | 90.0 parts |
| Yellow pigment 1 | 4.0 parts |
| Yellow pigment 2 | 1.0 part |
| Polyethylene wax 1 | 3.0 parts |
| Polyolefin-polyvinyl-based graft copolymer 1 | 0.5 part |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 8 having a volume average particle size $D_{50}$ of 7.5 μm.

Further, 100 parts of the yellow toner mother particle 8 and 0.7 part of hydrophobic silica ("RA200H", trade name; product of Nippon Aerosil) are mixed in a Henschel mixer to obtain a yellow toner 8. Then, the resulting toner is mixed with a carrier as in Example 1 to prepare a yellow developer 8.

Comparative Example 5

(Preparation of Yellow Toner 9)

| | |
|---|---|
| Polyester resin 1 | 74.5 parts |
| Yellow pigment 1 | 1.8 parts |
| Yellow pigment 2 | 1.2 parts |
| Polyethylene wax 1 | 3.0 parts |
| Polyolefin-polyvinyl-based graft copolymer 1 | 18.0 parts |
| Charge controlling agent 1 | 1.0 part |
| Infrared absorbing material 1 | 0.5 part |

The above-described components are mixed in powder form in a Henschel mixer. The resulting mixture is heat kneaded in an extruder set at 100° C. After cooling, the resulting kneaded mass is coarsely ground, finely ground, and then classified to obtain a yellow toner mother particle 9 having a volume average particle size $D_{50}$ of 8.7 μm.

Further, 100 parts of the yellow toner mother particle 9 and 0.7 part of hydrophobic silica ("RA200H", trade name; product of Nippon Aerosil) are mixed in a Henschel mixer to obtain a yellow toner 9. Then, the resulting toner is mixed with a carrier as in Example 1 to prepare a yellow developer 9.

(Evaluation Method)

Evaluation is performed using a machine obtained by remodeling "650J Continuous Feed Printing System" (trade name; product of Fuji Xerox) having a xenon flash lamp as an optical fixing device so that the peripheral speed of the developer holding member of the system is made variable. The peripheral speed of the developer holding member is set at 1,050 mm/s. An amorphous silicon drum is used as a photoreceptor and a heater of the photoreceptor is set at 40° C.

The remodeled machine has, as a cleaning device, a cleaning blade and has a mechanism of suctioning and collecting a toner, which has been removed by cleaning, by utilizing an air stream.

Under the environment having a temperature of 26° C. and humidity of 85%, an image having an image density of 0.4% is printed on 200,000 sheets of A4 paper by using the remodeled machine. Then, the contamination of the image due to poor cleaning is evaluated. When no image defects occur, the image is printed on further 200,000 sheets of A4 paper and the contamination is similarly evaluated. The paper used for the evaluation is "NPi form 55", trade name; product of Nippon Paper Group.

Evaluation is made according to the following criteria:

A: No image defects are observed visually when the image is printed on 400,000 sheets of paper.

B: Slight image defects are observed visually when the image is printed on 400,000 sheets of paper but they are hardly noticeable level.

C: No image defects are observed visually when the image is printed on 200,000 sheets of paper, but an unacceptable level of image defects are observed visually when the image is printed on 400,000 sheets of paper.

D: Image defects are observed visually when the image is printed on 200,000 sheets of paper and they are of an unacceptable level.

In addition, as the color development property of the toner, the chroma $c^*=((a^*)^2+(b^*)^2)^{1/2}$ is determined by printing, after adjustment of the amount of a toner attached to paper to 0.7 mg/cm$^2$, a 2 cm×2 cm solid image on the paper and then, measuring the hue (a*,b*) with a spectrodensitometer ("X-Rite 938", trade name; product of X-Rite). The color development property is evaluated according to the following criteria.

A: The chroma c* is 70 or greater.

B: The chroma c* is 65 or greater but less than 70.

C: The chroma c* is 60 or greater but less than 65.

D: The chroma c* is less than 60.

TABLE 1

| Examples and Comparative Examples | | | Examples | | | | | | Comparative Examples | | | | |
|---|---|---|---|---|---|---|---|---|---|---|---|---|---|
| | | | 1 | 2 | 3 | 4 | 5 | 6 | 1 | 2 | 3 | 4 | 5 |
| Amount (parts by weight) | Polyester resin | | 85.0 | 82.5 | 89.5 | 80.5 | 89.2 | 82.5 | 90.5 | 85.0 | 85.0 | 90.0 | 74.5 |
| | Azo pigment | PY155 | 4.0 | — | 4.0 | 1.8 | 4.0 | 1.0 | 4.0 | 5.0 | — | 4.0 | 1.8 |
| | | PR238 | — | 4.5 | — | — | — | — | — | — | — | — | — |
| | Non-azo pigment | PY139 | 1.0 | — | 1.0 | 1.2 | 0.2 | 4.0 | 1.0 | — | — | 1.0 | 1.2 |
| | | PR122 | — | 1.5 | — | — | — | — | — | | 5.0 | — | — |
| | Polyethylene wax | | 3.0 | 3.0 | 3.0 | 2.5 | 3.0 | 3.0 | 3.0 | 3.0 | 3.0 | 3.0 | 3.0 |

TABLE 1-continued

| Examples and Comparative Examples | | Examples 1 | 2 | 3 | 4 | 5 | 6 | Comparative Examples 1 | 2 | 3 | 4 | 5 |
|---|---|---|---|---|---|---|---|---|---|---|---|---|
| | Polyolefin polyvinyl-based graft copolymer | 5.5 | 7.0 | 1.0 | 12.5 | 2.1 | 8.0 | — | 5.5 | 5.5 | 0.5 | 18.0 |
| | Charge controlling agent | 1.0 | 1.0 | 1.0 | 1.0 | 1.0 | 1.0 | 1.0 | 1.0 | 1.0 | 1.0 | 1.0 |
| | Infrared absorbing material | 0.5 | 0.5 | 0.5 | 0.5 | 0.5 | 0.5 | 0.5 | 0.5 | 0.5 | 0.5 | 0.5 |
| Evaluation results | wd/wp (1) | 1.10 | 1.17 | 0.20 | 4.17 | 0.50 | 1.60 | 0.00 | 1.10 | 1.10 | 0.10 | 6.00 |
| | wp1/wp (2) | 0.20 | 0.25 | 0.20 | 0.40 | 0.05 | 0.80 | 0.20 | 0.00 | 1.00 | 0.20 | 0.40 |
| | Volume average particle size (μm) | 7.5 | 7.5 | 7.5 | 8.7 | 8.0 | 7.5 | 7.5 | 7.5 | 7.5 | 7.5 | 8.7 |
| | Evaluation of image contamination | A | A | B | B | B | A | D | D | B | D | C |
| | Evaluation of color development | A | A | A | B | A | B | B | A | D | B | D |

Abbreviations in Table 1 are as follows:
PY155: C.I. Pigment Yellow 155 (disazo pigment)
PR238: C.I. Pigment Red 238 (naphthol AS type azo pigment)
PY139: C.I. Pigment Yellow 139 (isoindoline pigment)
PR122: C.I. Pigment red 122 (quinacridone pigment)

What is claimed is:

1. An electrostatic-image-developing toner comprising:

a polyester resin;

two or more pigments that are (i) at least one azo-containing pigment having one or more azo groups in the molecule thereof, and (ii) at least one azo-free pigment;

a polyethylene wax; and a polyolefin-polyvinyl-based graft copolymer, wherein the electrostatic-image-developing toner satisfies the relationships represented by the following equations (1) and (2):

$$0.2 \leq wd/wp \leq 5.0 \quad (1); \text{ and}$$

$$0.05 \leq wp1/wp \leq 0.80 \quad (2),$$

wherein wp represents a total content (wt. %) of the pigments in the toner, wd represents a content (wt. %) of the polyolefin-polyvinyl-based graft copolymer in the toner, and wp1 represents a content (wt. %) of the azo-free pigment in the toner.

2. The electrostatic-image-developing toner according to claim 1, wherein the azo-free pigment contains at least one yellow pigment selected from the group consisting of isoindoline pigments, isoindolinone pigments, quinophthalone pigments, and anthraquinone pigments.

3. The electrostatic-image-developing toner according to claim 1, wherein the azo-free pigment contains at least one magenta pigment selected from the group consisting of quinacridone pigments, anthraquinone pigments, diketopyrrolopyrrole pigments, and perylene pigments.

4. The electrostatic-image-developing toner according to claim 1, wherein a content of the azo-containing pigment is within a range of from about 0.5 wt. % to about 10 wt. %.

5. The electrostatic-image-developing toner according to claim 1, wherein the content of the azo-free pigment is within a range of from about 0.1 wt. % to about 6 wt. %.

6. The electrostatic-image-developing toner according to claim 1, wherein the azo-containing pigment is C.I. Pigment Yellow 155 and the azo-free pigment is C.I. Pigment Yellow 139.

7. The electrostatic-image-developing toner according to claim 1, wherein the azo-containing pigment is C.I. Pigment Red 238 and the azo-free pigment is C.I. Pigment Red 122.

8. The electrostatic-image-developing toner according to claim 1, wherein the polyethylene wax has an endothermic peak, in DSC measurement (differential scanning calorimetry), at from about 50° C. to about 160° C.

9. The electrostatic-image-developing toner according to claim 1, wherein a content of the polyethylene wax is from about 0.5 wt. % to about 8 wt. % relative to the toner.

10. The electrostatic-image-developing toner according to claim 1, wherein the polyolefin-polyvinyl-based graft copolymer has a Tg (transition glass temperature) of from about 40° C. to about 80° C.

11. The electrostatic-image-developing toner according to claim 1, wherein the polyolefin-polyvinyl-based graft copolymer has a weight average molecular weight of from about 3,000 to about 50,000.

12. The electrostatic-image-developing toner according to claim 1, wherein the polyester resin has a weight average molecular weight of from about 5,000 to about 100,000.

13. The electrostatic-image-developing toner according to claim 1, wherein the polyester resin has a Tg (transition glass temperature) of from about 40° C. to about 80° C.

14. The electrostatic-image-developing toner according to claim 1, further comprising:

a diimmonium compound as an infrared absorbing material.

15. An electrostatic image developer comprising:

the electrostatic-image-developing toner as claimed in claim 1; and a carrier.

16. An image forming method comprising:

charging a surface of an image holding member;

forming an electrostatic latent image on the surface of the image holding member;

developing the electrostatic latent image with a developer containing a toner to form a toner image;

transferring the toner image to a transfer-receiving material, fixing the transferred toner image to the transfer-receiving material in accordance with an optical fixing system, and cleaning the toner which has remained on the surface of the image holding member without being transferred, wherein a developer holding member that holds the developer has a peripheral speed of about 1,000 mm/s or greater, the cleaning of the toner is performed by suctioning and collecting the toner, which has been removed using a cleaning blade, by utilizing an air stream, and the developer is the electrostatic image developer as claimed in claim 15.

* * * * *